US007281347B2

(12) United States Patent
Carpenter

(10) Patent No.: US 7,281,347 B2
(45) Date of Patent: Oct. 16, 2007

(54) RIFLE STAND

(76) Inventor: John T. Carpenter, 707 Delano, Walhalla, ND (US) 58282

( * ) Notice: Subject to any disclaimer, the term of this patent is extended or adjusted under 35 U.S.C. 154(b) by 0 days.

(21) Appl. No.: 11/337,781

(22) Filed: Jan. 23, 2006

(65) Prior Publication Data

US 2007/0169391 A1 Jul. 26, 2007

(51) Int. Cl.
*F41A 29/00* (2006.01)

(52) U.S. Cl. ..... 42/94; 89/37.04; 248/425; 248/416

(58) Field of Classification Search ..... 42/94; 89/37.04; 248/425, 415, 416, 431
See application file for complete search history.

(56) References Cited

U.S. PATENT DOCUMENTS 4,937,965 A * 7/1990 Narvaez ..... 42/94
6,058,641 A * 5/2000 Vecqueray ..... 42/94
6,931,777 B1 * 8/2005 Krien ..... 42/94

* cited by examiner

*Primary Examiner*—J. Woodrow Eldred
(74) *Attorney, Agent, or Firm*—Robert E. Kleve

(57) ABSTRACT

A gun support for precision shooting comprising a main support pole serving as a main stand having three adjustable legs. A rear gun stock support mounted at the top of the pole an extending laterally away from the pole for receiving the rear of the gun stock of a rifle. A pivotally mounted flange extends forward out from the rear gun stock support having a forward V-shaped rest thereon to receive the forward portion of the gun stock of the rifle, rotary adjustment means to adjust the pivotal position of the forward flange relative to the rear gun stock support for changing the generally vertical positioning of the forward portion of the rifle, while resting on the front and rear support. A seat is provided on the pole for the gun operator to sit upon while aiming and or firing his rifle while the gun stock of the rifle in resting in the front and rear gun stock supports. The seat is adjustable about a 360 degree range. The rear support is telescoping mounted in the main support pole for raising and lowering the rear support relative to the legs of the main pole.

3 Claims, 5 Drawing Sheets

RIFLE STAND

This invention relates to gun or rifle stands or more particularly the invention relates to rifle supports for such things as gun or rifle marksmanship competitions. This is also related to my disclosure document No. 550851 filed in the U.S. Patent and Trademark Office on Apr. 9, 2004, and priority benefits of which are claimed.

It is an object of the invention to provide a stand for supporting a rifle including a seat for the marksman to ship upon while firing the rifle with the rifle supported on the stand.

It is another object of the invention to provide a novel gun stand which can be adjusted for irregular terrain and that will support a gun thereon with means to adjust the gun in substantially to different elevations and different heights has would be needed in a customary rifle match.

It is another object of the invention to provide a novel gun stand for supporting the gun in different positions while target shooting and further objects and advantages of the invention will become apparent as the description proceeds and when taken in conjunction with the accompanying drawings wherein.

Figure 1:
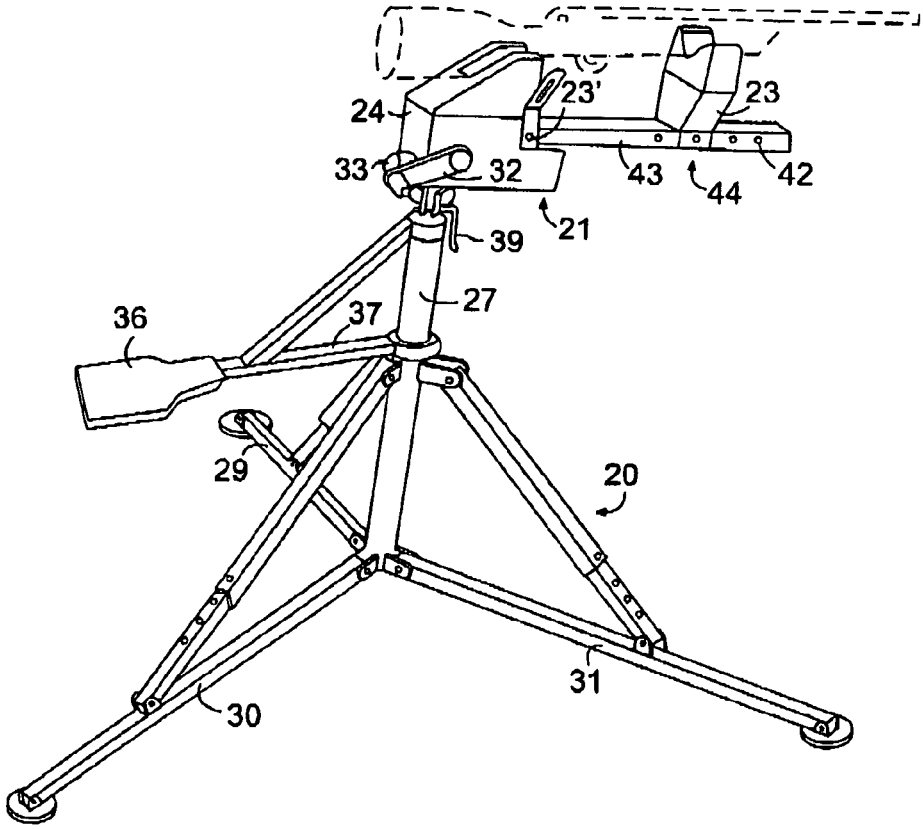
FIG. 1 is a perspective view of the gun stand invention illustrating the gun in position on the stand in phantom lines.
Figure 2:
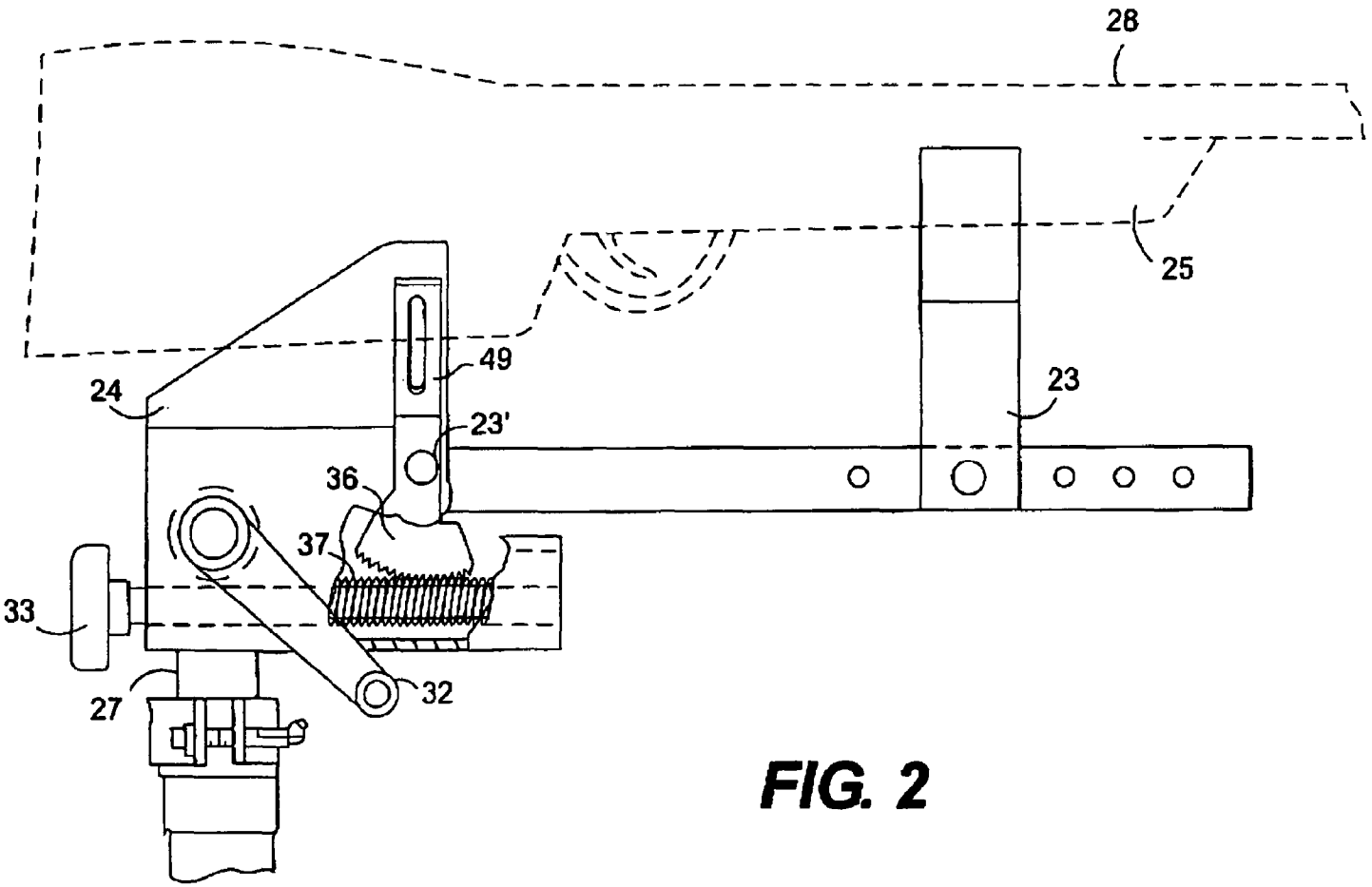
FIG. 2 is a fragmentary side elevational view of the upper portion of the gun stand.
Figure 3:
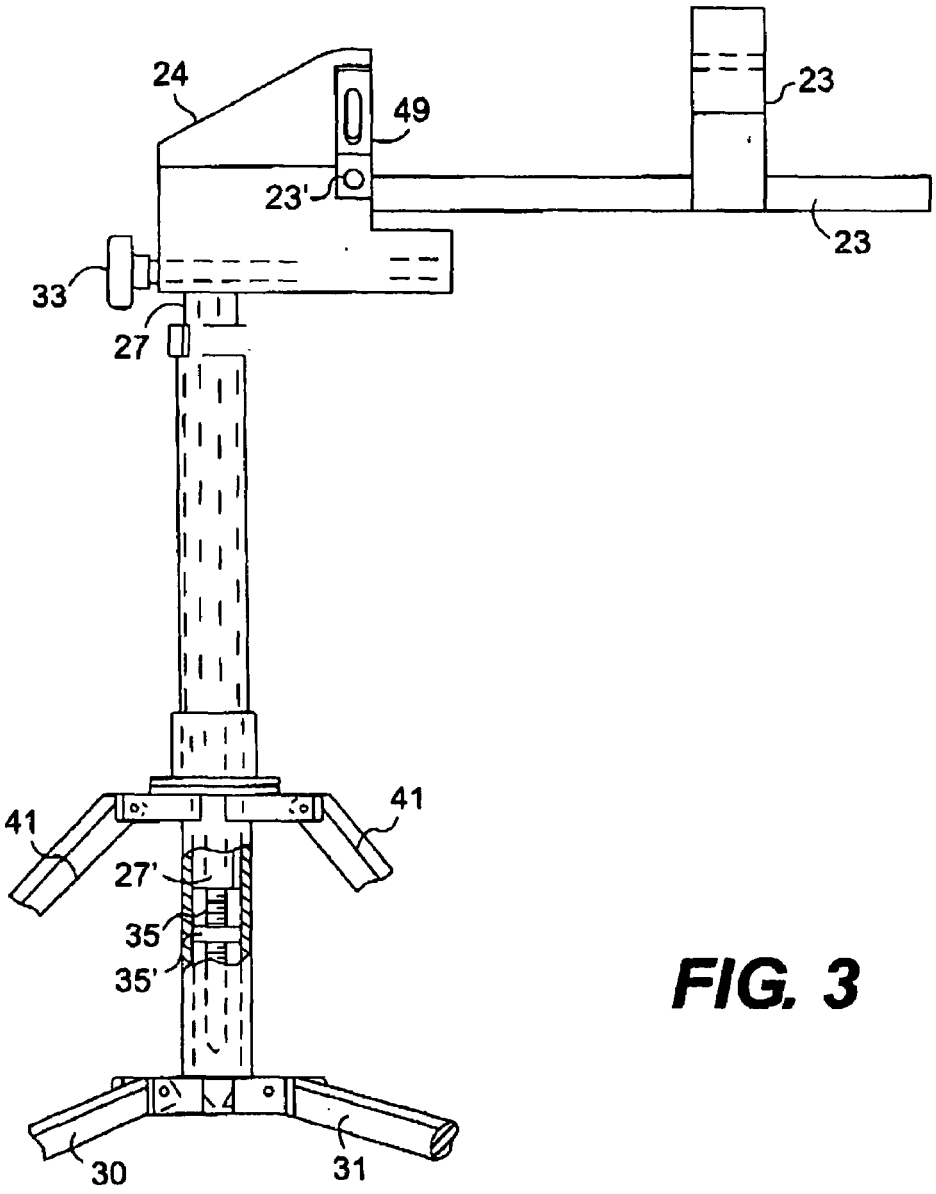
FIG. 3 is a fragmentary side elevational view of the intermediate and upper portion of the gun stand.
Figure 5:
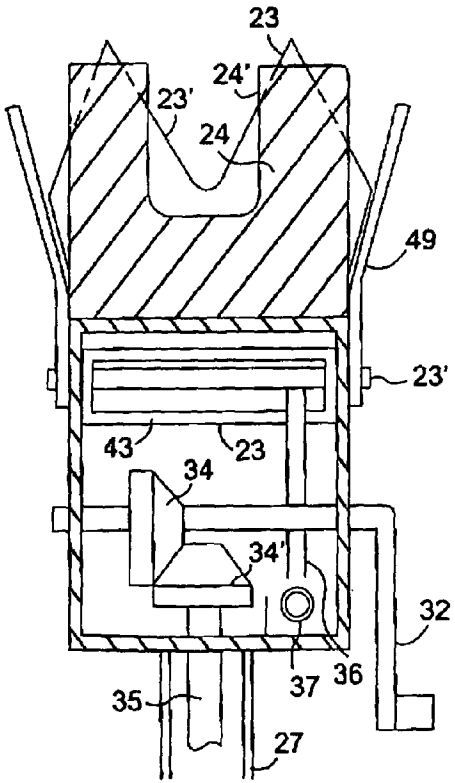
FIG. 5 is a cross sectional view of the upper portion of the gun stand taken along line 5-5 of FIG. 2.
Figure 4:
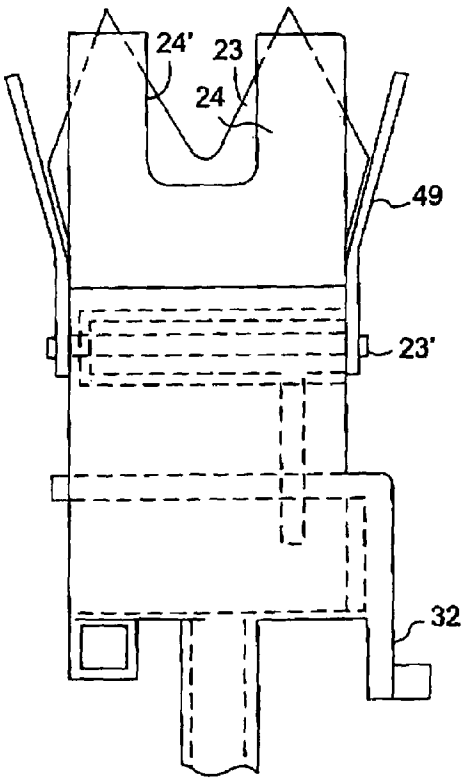
FIG. 4 is a rear view of the upper portion of the gun stand taken along line 4-4 of FIG. 2.
Figure 6:
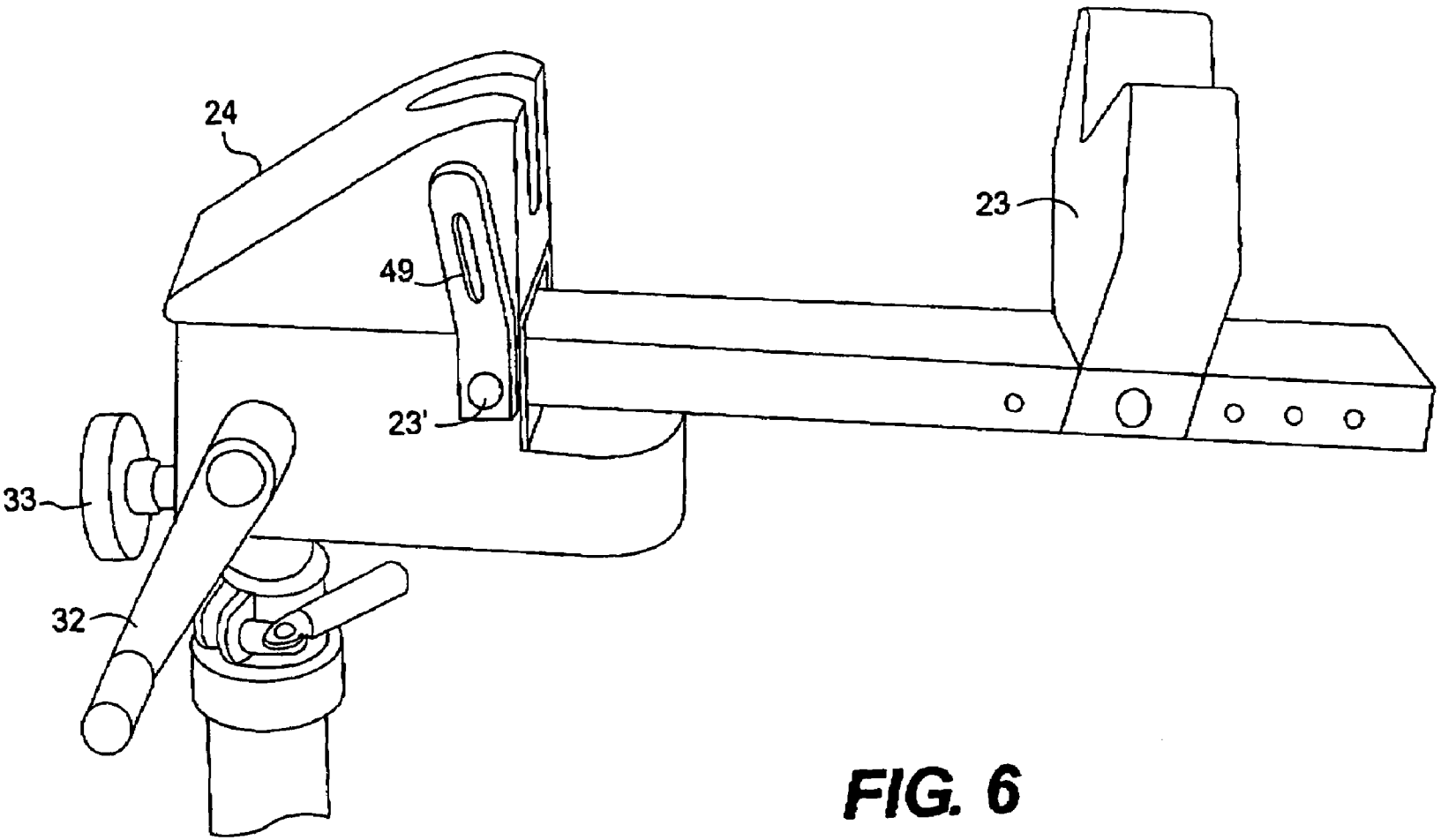
FIG. 6 is a perspective view of the upper portion of the gun stand.

Referring more particularly to the drawings in FIG. 1 the gun stand invention or apparatus 20 is shown having an gun rest support 21 which serves as an overall gun rest in connection with marksmanship contests and the like.

Gun Rest Support

The gun stand invention 20 has a pivotally mounted slotted gun rest 21 is mounted at the top of the tubular support 22. The gun rest 21 has a forward rest member 23 and a rearward rest member 24 with the forward rest member 23 has a shaft 23' fixed to its rearward end which shaft is pivotally mounted to the rearward rest member 24 in bores in the rearward rest member to provide the pivotal mounting 23'. The forward rest member 23, in its slot 23', receives the forward portion 25' of the rifle stock 25 of the rifle 26. The rearward gun rest 24, in its slot 24', receives the rearward portion 25" of the rifle stock 25. The gun rest support 21 is shown in FIG. 1 supporting the rifle 26 as just described.

The rearward gun rest 24 is fixed to the top of the tubular support 22. The tubular support 22 is slidably mounted in the top of the main support shaft 27. The main support shaft 27 telescopes in the vertical sleeve 28. The vertical sleeve 28 is held upright by three tripod legs 29, 30 and 31 that when operatively positioned diverge downwardly into a tripod form to support the stand.

The gun stand invention 20 has two adjustment controls, a rotating knob 32 and a crank 33. The rotating knob 32 is mounted to the rear gun rest 24 and is rotated to angularly adjust the forward rest member 23 gun rest 21 about its pivotal mounting 23' to the rearward gun rest 24 to adjust the angle of the forward rest member 23 in small fractional increments.

The crank 33 is rotatably mounted to the side of the rear gun rest housing 24. The crank 33, rotates about axis 33', and through cornering gears 34 and 34' drives the generally upright rod 35 within the vertical sleeve 28. The upright rod 35 is threaded into a fixed threaded nut 35' fixed in the bottom of the sleeve 28.

The crank 33 is rotated to drive the rod 35 in the threaded nut 35' within the vertical sleeve 28 to raise and lower the rod and therefore raise and lower the rearward gun rest member 23 in the sleeve 28 and thereby raise and lower the forward gun rest member 23 mounted to the rear gun rest member, respectively, to which it is pivotally mounted thereto.

The shaft 23' of the forward gun rest has an arcuate gear segment 36 with teeth 36' along the arcuate outer portion of the gear segment. The knob 32 has a shaft 37 fixed to its forward end which extends forward in the housing of the rear gun rest. The shaft 37 has spiral groove 37' which meshes with the teeth 36' of the gear segment. The shaft 37 is rotatably mounted in the housing 38 of the rear gun rest so that rotating the knob rotates the shaft axially, with its spiraling engaging the teeth of the gear segment to drive the gear segment forward or rearward thereby driving the shaft of the forward gun rest axially in its pivotal mounting to thereby pivot the gun rest upward or downward about its pivotal mounting to thereby raise or lower the forward gun rest relative to the rear gun rest so as to adjust the angle of the gun rest and the forward portion of the gun stock together with the rifle upward or downward relative to the apparatus 20.

Seat

A seat 45 has a mounting arm 46 fixed to the seat 45 at one end and has a ring 47 at the other end which is rotatively mounted on the vertical sleeve 28 about thereto. The seat 45 is provided for the operator to sit upon and is adjustably mounted by sliding the seat 45 about the vertical sleeve 28 to various positions on the main tubular support 22 axially about 360 degrees.

The gun rest support 21 can be adjusted vertically by rotating the crank 32 and held there by a tightening crank 48 on the vertical sleeve 28.

Tripod Legs

The tripod legs 29, 30 and 31 each are pivotally mounted to the center post 27 at their one ends 40 and have circular plates 40' pivotally mounted at their outer ends for engagement with the ground. Each leg has a telescoping brace 41 formed by an inner and outer sleeve, 42 and 42'.

The outer sleeve 42' of the brace of a leg is pivotally mounted to the center post as its one end 41' and the inner sleeve 42' is pivotally mounted to that leg as its pivotal mounting 41".

The inner sleeve 42 can slide relative to the outer sleeve 42' to adjust its overall length as a brace. The inner sleeves 42 of each brace each have a plurality holes 42" at spaced intervals along the length of the inner sleeve and the outer sleeve has a single hole 42'" so that a pin can be inserted into the single hole and a selected on of the spaced holes in the inner sleeve to adjust the length of the braces and thereby adjust any of the three legs to different individual angular positions, depending upon the terrain which the device is resting on, by adjusting the legs to suitable different positions as desired.

The forward gun rest 23 has a plurality of spaced holes 49 along the frame member 43 to adjust the forward gun member 23 to different positions along the frame member 43 for different size rifles 26. The forward gun rest 23 has a single bore 44 to receive a pin which can be inserted in one of the spaced holes 49 at its selected position.

Accessory Tray

The gun stand invention 20 has a bullet and accessory tray. The accessory tray can be mounted on either side of the main tubular support 22. The accessory tray has an arm that is slidably receivable in one of the slots 52 on a side of the main tubular support 22 so that you can have the gun rest on the right side for right handed people and on the other side for left handed people. The accessory tray is mounted on the main support housing 22 below the main structure of the forward and rearward gun rests 23 and 24 to provide quick access to bullets for the operator when operating his rifle 26.

Strap Support

The main tubular support 22 has a pair of projecting flanges 50 and 51 projecting upward and outward adjacent to the rear gun rest 24 with a pair of slots 50' and 51' in the flanges 50 and 51 for receiving a strap for strapping the rear stock portion 25" of the rifle 26 to the rearward rest member 24 and the forward stock portion to the forward rest member 23.

It will be obvious that various changes and departures may be made to the invention without departing from the spirit and scope thereof and accordingly is not intended that the invention be limited to that specifically described in the specification or as described in the drawings but only as set forth in the appended claims wherein:

What is claimed is:

1. A gun support for precision shooting comprising a main support pole serving as a main stand having adjustable legs, a seat for the gun operator to sit upon having a rotatable support to the pole and being individually adjustable on the pole about a 360 degree range, a rear gun stock support mounted at the top of the pole an extending laterally away from the pole, said rear gun stock support having a slot to receive the rearward portion of a gun stock, a pivotally mounted flange extending out from the rear gun stock support having a slotted forward rest thereon to receive the forward portion of a gun stock, rotary adjustment means on said rear gun stock support to adjust the pivotal position of the flange relative to the rear gun stock support upward and downward relative to the main pole for changing the positioning of firing a gun resting on the front and rear support in a generally vertical plane, said rear support having a telescoping pole telescoping relative to the main pole for raising and lowering the rear support relative to the legs on the main pole.

2. A gun support for precision shooting comprising a main support pole serving as a main stand having three adjustable legs, a seat for the gun operator to sit upon having a rotatable support to the pole and being individually adjustable on the pole about a 360 degree range, a rear gun stock support mounted at the top of the pole an extending laterally away from the pole, said rear gun stock support having a slot to receive the rearward portion of a gun stock, a pivotally mounted flange extending out from the rear gun stock support having a slotted forward rest thereon to receive the forward portion of a gun stock, rotary adjustment knob on said rear gun stock support, said knob having a screw fixed to its forward end, said forward gun support having a gear portion fixed to its pivotal mounting and in engagement with said screw so that rotation of the knob will rotate the screw which in turn through its engagement with the radial gear to pivot the gear and thereby pivot the forward gun support to adjust the pivotal position of the forward gun support relative to the rear gun stock support upward and downward about the pivot relative to the main pole for changing the positioning of firing a gun resting on the front and rear support in a generally vertical plane, said rear support having a telescoping pole within the main pole for raising and lowering the rear support relative to the legs on the main pole.

3. A gun support for precision shooting comprising a main upward extending elongated pole support, means to support the main pole in an upstanding position, a seat for the operator to sit upon adjustable axially about the pole horizontally and adjustable vertically on the pole to accommodate different positions and different size operators, a forward and rearward gun support, a support pole adjustable to different positions on the main pole, said rearward gun support being mounted at the top of the support pole, said forward gun support being pivotally mounted to said rear gun support for receiving and supporting a gun stock of a gun at the forward and rearward portions of the gun stock respectively, means to pivotally adjust the forward gun support relative to the rearward gun support, means to adjust the angle of the forward support relative to the ground.

* * * * *